US011365744B2

(12) United States Patent
Sheth et al.

(10) Patent No.: US 11,365,744 B2
(45) Date of Patent: Jun. 21, 2022

(54) IMPELLER LOCKING METHOD

(71) Applicant: Halliburton Energy Services, Inc., Houston, TX (US)

(72) Inventors: Ketankumar Kantilal Sheth, Tulsa, OK (US); Jason Eugene Hill, Bristow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 129 days.

(21) Appl. No.: 16/996,076

(22) Filed: Aug. 18, 2020

(65) Prior Publication Data

US 2022/0056919 A1 Feb. 24, 2022

(51) Int. Cl.

| | |
|---|---|
| ***F04D 29/043*** | (2006.01) |
| ***E21B 43/12*** | (2006.01) |
| ***F04D 29/44*** | (2006.01) |
| ***F04D 29/24*** | (2006.01) |
| ***F04D 1/00*** | (2006.01) |

(52) U.S. Cl.

CPC ..... *F04D 29/043* (2013.01); *E21B 43/121* (2013.01); *F04D 1/00* (2013.01); *F04D 29/24* (2013.01); *F04D 29/445* (2013.01)

(58) Field of Classification Search

CPC .... F04D 29/041; F04D 29/043; F04D 29/266; F04D 29/20; F04D 13/08; F04D 13/10; F16C 2226/76; F16D 1/0829; F16D 1/0852; F16D 1/087

See application file for complete search history.

(56) References Cited

U.S. PATENT DOCUMENTS

| | | | | |
|---|---|---|---|---|
| 3,884,595 | A * | 5/1975 | Herrick | F04D 29/266 416/198 A |
| 4,547,126 | A | 10/1985 | Jackson | |
| 7,018,177 | B2 | 3/2006 | Feher | |
| 8,157,510 | B2 * | 4/2012 | Bear | F04C 15/0076 415/141 |
| 2005/0111984 | A1 | 5/2005 | Hodowanec | |
| 2012/0257985 | A1 * | 10/2012 | Parmeter | F04D 29/047 417/53 |

(Continued)

FOREIGN PATENT DOCUMENTS

| | | | |
|---|---|---|---|
| CN | 2849251 | Y | 12/2006 |
| JP | 2017133450 | A | 8/2017 |
| WO | 2016081389 | A1 | 5/2016 |

*Primary Examiner* — Brian P Wolcott
*Assistant Examiner* — Jackson N Gillenwaters
(74) *Attorney, Agent, or Firm* — John Wustenberg; Parker Justiss, P.C.

(57) ABSTRACT

Provided in one example is a centrifugal pump. The centrifugal pump, according to this example, includes a shaft having an axial keyway located therein, as well as an axial key positioned within the axial keyway, the axial key having a recess located in a radial exterior surface thereof. The centrifugal pump according to this example additionally includes an impeller positioned on the shaft about the axial key, and a retaining ring positioned on the shaft about the axial key, a portion of the retaining ring extending into the recess for axially fixing the retaining ring relative to the axial key. The centrifugal pump according to this example further includes one or more fasteners attaching the retaining ring to the impeller, and a diffuser coupled about the shaft and proximate the impeller.

20 Claims, 5 Drawing Sheets

(56) References Cited

U.S. PATENT DOCUMENTS

| | | | | |
|---|---|---|---|---|
| 2013/0315517 | A1* | 11/2013 | Tetzlaff | F04D 13/08<br>384/226 |
| 2018/0045209 | A1* | 2/2018 | Nowitzki | F04D 29/0473 |
| 2018/0313397 | A1* | 11/2018 | Butler | B65H 5/06 |

* cited by examiner

IMPELLER LOCKING METHOD

BACKGROUND

Fluid, such as gas, oil or water, is often located in subterranean formations. In such situations, the fluid must be pumped to the earth's surface so that it can be collected, separated, refined, distributed and/or sold. Centrifugal pumps are typically used in electric submersible pump applications for lifting well fluid to the earth's surface and also in the water well applications, and numerous surface industrial applications ranging from nuclear, petrochemicals, process, city etc. Centrifugal pumps impart energy to a fluid by accelerating the fluid through a rotating impeller paired with a stationary diffuser. The rotation confers angular momentum to the fluid passing through the centrifugal pump. The angular momentum converts kinetic energy into pressure, thereby raising the pressure on the fluid and lifting it to the earth's surface. Multiple stages of impeller and diffuser pairs may be used to further increase the pressure.

In large diameter multistage centrifugal pumps, each impeller is often fixed to the rotating shaft by a multi-piece (e.g., two piece) ring positioned in a circumferential groove, and a key positioned within an axial keyway located along a length of the shaft. The multi-piece ring, in this example, transfers the thrust load from the impeller to the shaft, as well as prevents relative axial movement between the impellers and the shaft. Additionally, the key and keyway transfer the rotational torque from the shaft to the impeller.

Typically, a rectangular or square circumferential groove is machined in the shaft, such that the multi-piece ring may be partially recessed within the shaft and affixed to the impeller, thereby axially fixing the impeller to the shaft. This machined groove often represents the smallest diameter of the shaft, and thus is a limiting factor when transmitting torque from the shaft to the impeller.

BRIEF DESCRIPTION

Reference is now made to the following descriptions taken in conjunction with the accompanying drawings, in which.

DETAILED DESCRIPTION

Figure 1:
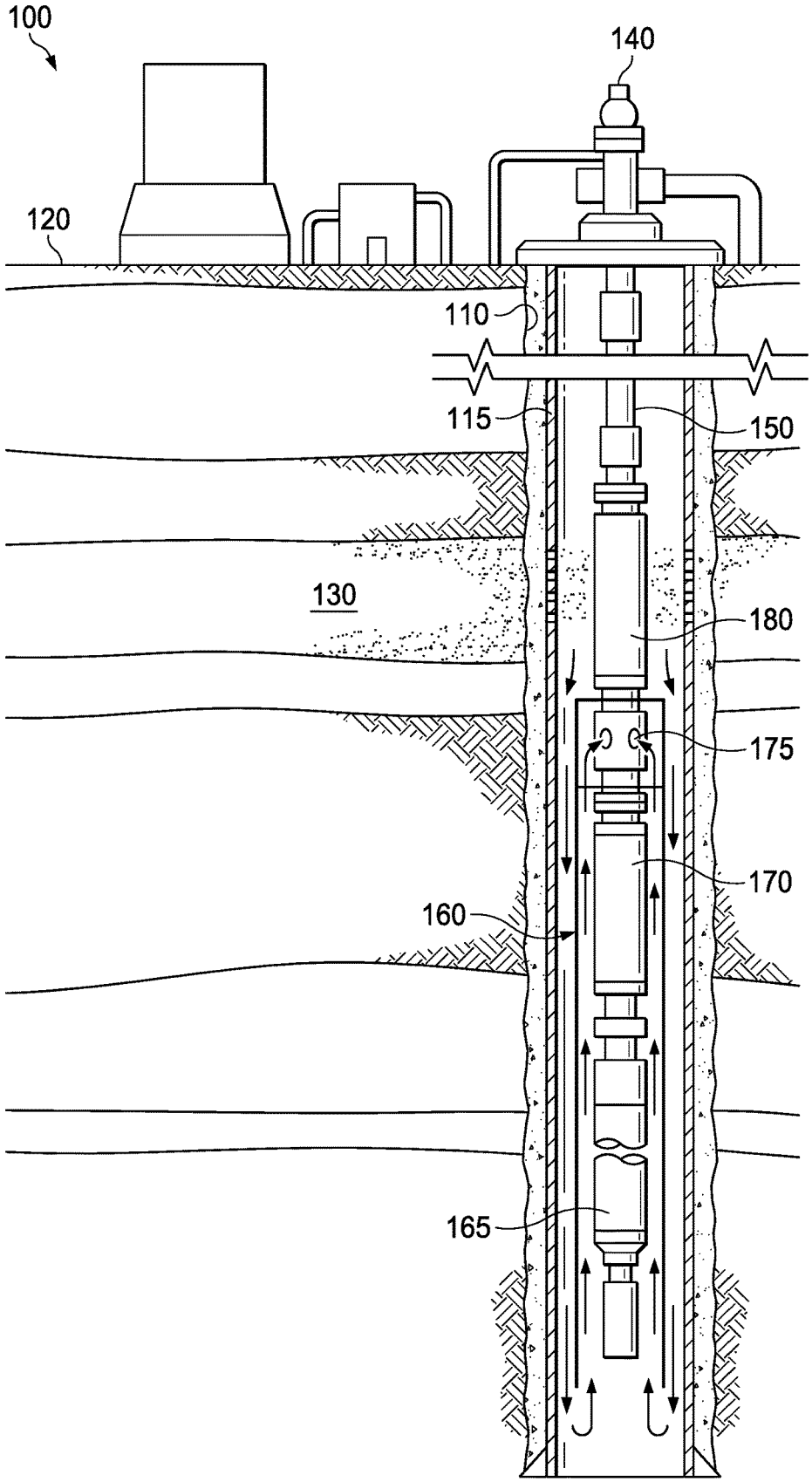
FIG. 1 illustrates a cross-sectional view of a well system designed, manufactured, and operated according to one or more examples of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the subterranean formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

FIG. 1 illustrates a cross-sectional view of a well system 100 designed, manufactured, and operated according to one or more examples of the disclosure. As depicted, the well system 100 includes a wellbore 110 extending from the earth's surface 120 and penetrating one or more subterranean formations 130 for the purpose of recovering hydrocarbons therefrom. The subterranean formation 130 may be located below exposed earth, as shown, as well as areas below earth covered by water, such as ocean or fresh water.

The wellbore 110 may be drilled into the subterranean formation 130 using any suitable drilling technique. In the example illustrated in FIG. 1, the wellbore 110 extends substantially vertically away from the earth's surface 120. In alternative operating environments, all or portions of a wellbore 110 may be vertical, deviated at any suitable angle, horizontal, and/or curved. The wellbore 110 may be a new wellbore, an existing wellbore, a straight wellbore, an extended reach wellbore, a sidetracked wellbore, a multilateral wellbore, or any other type of wellbore for drilling and completing one or more production zones. In one or more examples, the wellbore 110 includes wellbore casing 115, which may be cemented into place in the wellbore 110. In other examples, all or a portion of the wellbore 110 is uncased or partially cased.

The well system 100 of FIG. 1 additionally includes a wellhead 140, in this embodiment positioned at the earth's surface, as well as a wellbore conveyance 150 extending from the wellhead 140 into the one or more subterranean formations 130. The example shown in FIG. 1 illustrates the wellbore conveyance 150 in the form of production tubing disposed in the wellbore 110. It should be understood that the wellbore conveyance 150 is equally applicable to any type of wellbore conveyance being inserted into a wellbore 110, including as non-limiting examples pipe, casing, liners, jointed tubing, coiled tubing, etc. Further, the wellbore conveyance 150 may operate in any of the wellbore orientations (e.g., vertical, deviated, horizontal, and/or curved) and/or types described herein.

Coupled to the wellbore conveyance 150, in the example illustrated in FIG. 1, is a pump assembly 160. The pump assembly 160, in this embodiment, is a submersible pump assembly employed to help raise hydrocarbons from deep within the wellbore 110 to the wellhead 140 at the earth's surface 120. The pump assembly 160, in the illustrated embodiment, includes a rotary actuator 165. The rotary actuator can be any direct and indirect driver including but not limited to an electric motor, a turbine, a hydraulic motor, a gearbox, belt driven actuator, chain driven actuator, or any other mechanism for providing rotary motion to the pump. The rotary actuator 165, in this embodiment, is an electric motor. For example, the electric motor might be the deepest component of the pump assembly 160 (e.g., other than downhole sensors). The rotary actuator 165 may be a two-pole, three-phase squirrel cage induction motor, in one embodiment. Other rotary actuators, however, are within the scope of the disclosure. For example, any rotary actuator 165 capable of imparting rotational motion (e.g., on the shaft of the centrifugal pump) could be used. Uphole of the rotary actuator 165 in the embodiment of FIG. 1 is seal section 170. The seal section 170, in this embodiment, carries the thrust of a centrifugal pump 180, and equalizes pressure to the rotary actuator 165. One or more intakes 175 may be uphole of the seal section 170, and serve as the intakes for well fluid into the pump assembly 160. The intakes 175 may include intake ports and/or one or more slotted or perforated screens.

The centrifugal pump 180, in accordance with the disclosure, includes one or more stages, each stage including an impeller that is attached to and configured to rotate with a central shaft driven by the rotary actuator 165, as well as a stationary diffuser. In operation, as the central shaft turns, and thus the impeller turns, vanes on the impeller impart velocity to the wellbore fluid (e.g., crude oil). As the wellbore fluid is carried to the outermost portion of the impeller vanes, it is transferred to the adjoining stationary diffuser. The diffuser transforms the fluid velocity into hydraulic head, or pressure. In turn, the diffuser guides the fluid upward into the impeller of the next stage, and ultimately up the conveyance 150 to the wellhead 140 located at the earth's surface. The centrifugal pump 180 may include any number of stages and remain within the disclosure. In some multistage centrifugal pumps, the diffusers are bolted together and not housed in a housing. In some pumps diffuser is replaced with volute and or casing. Volute or casing can be in one or more pieces.

A centrifugal pump, according to the disclosure, includes a shaft having an axial keyway located therein. The centrifugal pump further includes an axial key positioned within the axial keyway of the shaft, the axial key having a recess located in a radial exterior surface thereof. The centrifugal pump additionally includes an impeller positioned on the shaft about the axial key. The centrifugal pump, according to this embodiment, further includes a retaining ring positioned on the shaft about the axial key, a portion of the retaining ring extending into the recess in the axial key for axially fixing the retaining ring relative to the axial key. The centrifugal pump, according to this embodiment, additionally includes one or more fasteners attaching the retaining ring to the impeller, and a diffuser coupled about the shaft and proximate the impeller. According to this embodiment, the recess in the axial key axially fixes the retaining ring relative to the axial key, as opposed to a circumferential groove in the shaft in existing systems. Thus, in certain embodiments, the shaft is void of any circumferential grooves having a width greater than 1.5 mm (or even 3.0 mm) within 200 mm of the axial keyway, in an alternative embodiment void of any circumferential grooves having a width greater than 1.5 mm (or even 3.0 mm) within 100 mm of the axial keyway, in yet another alternative embodiment void of any circumferential grooves having a width greater than 1.5 mm (or even 3.0 mm) within 50 mm of the axial keyway, in yet another alternative embodiment void of any circumferential grooves of any size under the axial keyway, or in yet another alternative embodiment the shaft is void of any circumferential grooves along its shaft length ($S_l$).

A centrifugal pump according to the disclosure has certain benefits over existing centrifugal pumps. First, the manufacturing cost of the shaft of the centrifugal pump is greatly reduced with the removal of the circumferential grooves. For example, a hollow lathe and shaft supporting structure must be employed to properly machine the circumferential grooves within the shaft. Such a machining process is time consuming and costly. Second, the exclusion of the circumferential grooves increases the shaft strength, thus allowing for higher horsepower capacity for the same diameter shaft. While a few benefits have been highlighted, additional benefits exist beyond those discussed in this section.

It should be noted that while the present disclosure is discussing the pump assembly, as well as the centrifugal pump, for use in downhole oil/gas applications, the present disclosure should not be limited to such. In fact, the inventive aspects of the present disclosure may be used in any pump assembly, and/or centrifugal pump, regardless of its intended use. The centrifugal pump described here can be used for any duties, either submerged, in the well, above the seabed, or on the ground in any application including but not limited to nuclear industry, water well, petrochemical, chemical, industrial, city water, mining and any other applications.

Figure 2:
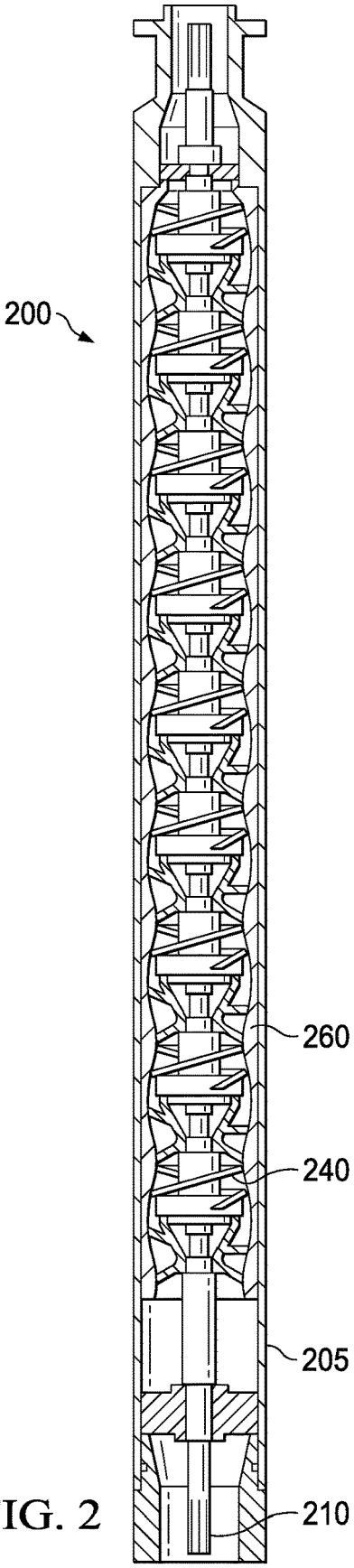
FIG. 2 illustrates a cross-sectional view of centrifugal pump designed, manufactured and operated according to one embodiment of the disclosure.

FIG. 2 illustrates a cross-sectional view of centrifugal pump 200 designed, manufactured and operated according to one embodiment of the disclosure. The centrifugal pump 200 illustrated in FIG. 2 is a multi-stage centrifugal pump. In fact, the centrifugal pump 200 illustrated in FIG. 2 is a nine-stage centrifugal pump. While the embodiment of FIG. 2 illustrates a multi-stage pump, and moreover a nine-stage centrifugal pump, the present disclosure is not limited to multi-stage pumps, and could also be used with single-stage pumps. Each of the nine-stages of the centrifugal pump 200 includes an impeller 240 rotationally attached to the shaft 210, as well as a diffuser 260 coupled to a housing 205 thereof. While the housing 205 is illustrated in FIG. 2, other embodiments may exist wherein no housing is used, just the diffuser is used, or a volute is used.

Figure 3:
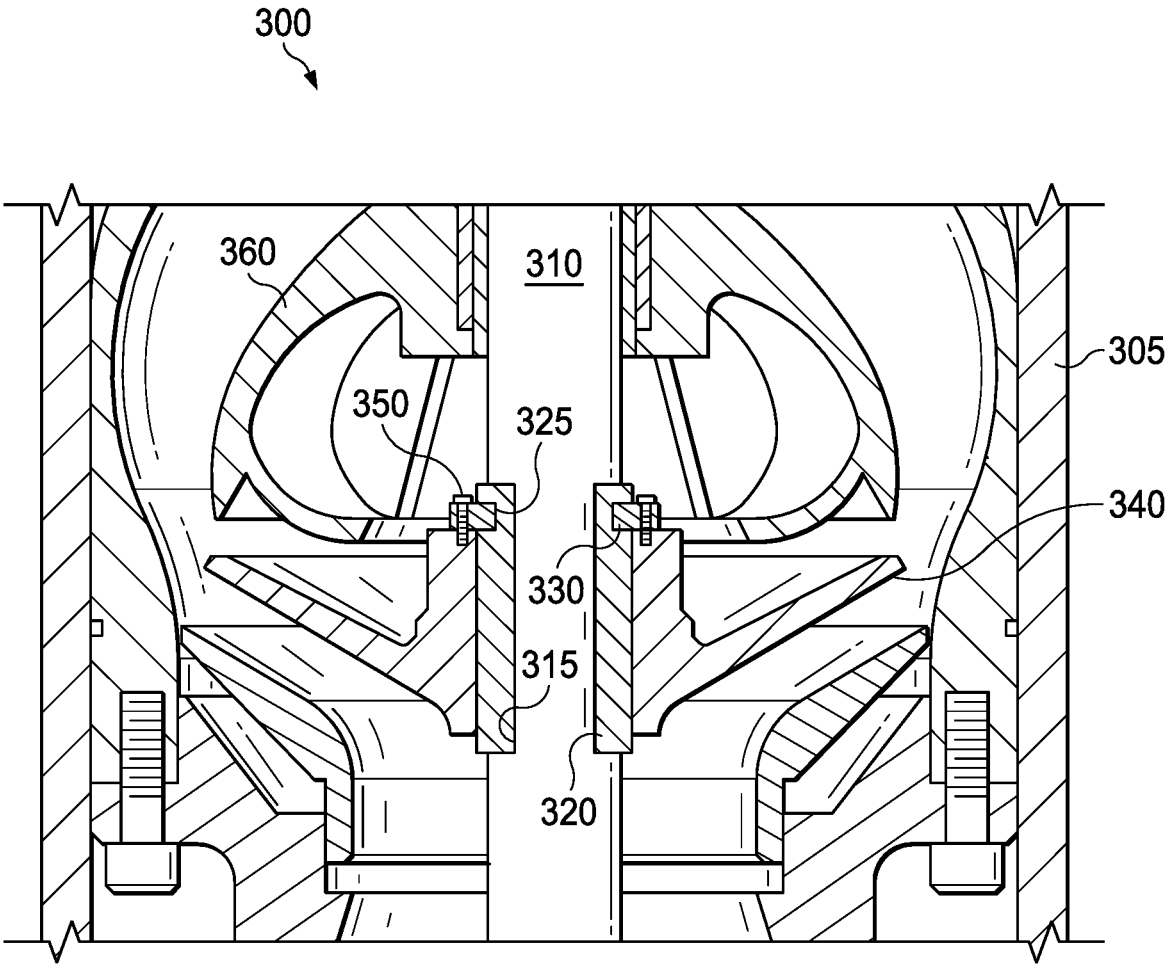
FIG. 3 illustrates an enlarged cross-sectional view of one stage of a centrifugal pump designed, manufactured and operated according to the disclosure.

FIG. 3 illustrates an enlarged cross-sectional view of one stage of a centrifugal pump 300 designed, manufactured and operated according to the disclosure. The centrifugal pump 300 includes a shaft 310 positioned within a housing 305. The shaft 310, in accordance with one embodiment of the disclosure, includes an axial keyway 315 located therein. In certain embodiments, the shaft 310 includes two or more axial keyways 315 per stage of the centrifugal pump. In those embodiments wherein two or more axial keyways 315 are employed, the two or more axial keyways 315 may be axially aligned along the shaft 310, as shown in FIG. 3. Additionally, in those embodiments wherein two or more axial keyways 315 are employed, the two or more axial keyways 315 may be placed circumferentially equidistance around the shaft. For instance, if first and second axial keyways 315 are employed, such as that illustrated in FIG. 3, they would be located at 0-degrees and 180-degrees, respectively. If four axial keyways 315 are employed, they would be located at 0-degrees, 90-degrees, 180-degrees and 270-degrees, respectively. The circumferentially equidistance theory applies to any number of axial keyways 315.

The centrifugal pump 300 illustrated in FIG. 3 additionally includes an axial key 320 positioned within the axial keyway 315. In the embodiment of FIG. 3, first and second axial keys 320 are positioned within the first and second axial keyways 315. Were the shaft 310 to have four axial keyways 315, the centrifugal pump 300 would likely include four axial keys 320. In accordance with the disclosure, the axial keys 320, for a given stage, each include a recess 325 located in a radial exterior surface thereof.

The centrifugal pump 300 illustrated in FIG. 3 additionally includes a retaining ring 330 positioned on the shaft 310 about the axial keys 320. In accordance with the disclosure, a portion of the retaining ring extends into the recesses 325 for axially fixing the retaining ring 330 relative to the axial keys 320. Additional details for certain embodiments of the retaining ring 330 will be discussed below with regard to FIGS. 4A-4D.

The centrifugal pump 300, in the illustrated embodiment, additionally includes an impeller 340 positioned on the shaft 310 about the axial keys 320. In accordance with one embodiment of the disclosure, the impeller 340 includes one or more impeller cutouts for sliding the impeller 340 over the axial keys 320. The combination of the axial keyways 315, axial keys 320 and impeller cutouts, in at least one embodiment, rotationally fix the impeller 340 with the shaft 310. While a specific impeller 340 design has been illustrated in FIG. 3, the present disclosure is not limited to any specific impeller 340 design.

In the illustrated embodiment, one or more fasteners 350 attach the retaining ring 330 to the impeller 340. For example, the retaining ring 330 might have one or more openings extending entirely there through, and the impeller 340 might have one or more threaded openings therein. Accordingly, in one embodiment the one or more fasteners are one or more bolts that extend through the one or more openings in the retaining ring 330 and engaging the threaded openings in the impeller 340. While threaded bolts have been illustrated and described, in an alternative embodiment one or more threaded posts may be attached to the impeller 340, and one or more nuts may be used to attach the impeller 340 to the retaining ring 330. In yet another embodiment, the one or more fasteners are one or more rivets, or alternatively the one or more fasteners is a clip or adhesive.

The centrifugal pump 300 in the embodiment of FIG. 3 additionally includes a diffuser 360 coupled (e.g., to the housing 305) about the shaft 310 and proximate the impeller 340. The diffuser 360, in accordance with the disclosure, does not rotate with the shaft 310. In those embodiments wherein the housing 305 is employed, the diffuser 360 may be rotationally fixed relative to the housing 305. While a specific diffuser 360 design has been illustrated in FIG. 3, the present disclosure is not limited to any specific diffuser 360 design.

Figure 4A:
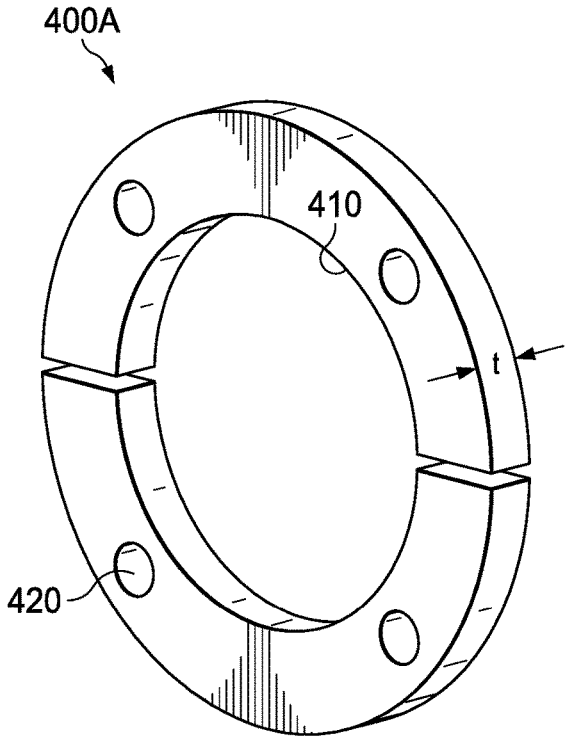
FIGS. 4A-4D illustrate various different embodiments for retaining rings designed and manufactured according to the disclosure.

FIGS. 4A-4D illustrate various different embodiments for retaining rings 400A-400D designed and manufactured according to the disclosure. FIG. 4A illustrates a multi-piece retaining ring 400A having a central opening 410 for positioning around a pump shaft (e.g., the shaft 310 illustrated in FIG. 3). The multi-piece retaining ring 400A of FIG. 4A is a two-piece retaining ring, nevertheless, other multi-piece designs having more than two pieces are within the scope of the disclosure.

The multi-piece retaining ring 400A illustrated in FIG. 4A includes one or more openings 420 extending entirely through a thickness (t). In the illustrated embodiment, the multi-piece retaining ring 400A includes multiple (e.g., four in the illustrated embodiment) openings 420 positioned equidistance around the multi-piece retaining ring 400A. In the illustrated embodiment, the multiple openings 420 are positioned at 45-degrees, 135-degrees, 225-degrees, and 315-degrees, respectively. Nevertheless, the multiple openings 420 could be positioned at 0-degrees, 90-degrees, 180-degrees, and 270-degrees, respectively, among other configurations. The openings 420, in accordance with the disclosure, align with associated openings in the impeller (e.g. impeller 340 of FIG. 3).

To assemble, the pieces of the multi-piece retaining ring 400A would be positioned on the pump shaft about the axial key, a portion of each of the pieces of the multi-piece retaining ring 400A extending into the recesses in the axial keys for axially fixing the multi-piece retaining ring 400A relative to the axial keys. The multi-piece retaining ring 400A could then be fixedly attached to the impeller, for example using the openings 420 and one or more fasteners.

Figure 4B:
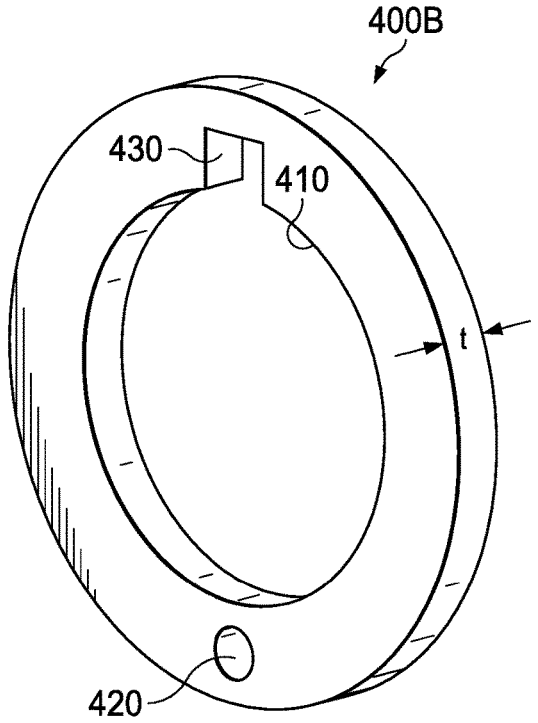

FIG. 4B illustrates a single-piece retaining ring 400B designed and manufactured according to the disclosure. The single-piece retaining ring 400B includes certain of the same features as the multi-piece retaining ring 400A. Accordingly, like reference numbers have been used to indicate similar, if not identical, features. In addition to the single-piece retaining ring 400B comprising only a single unsegmented piece, the single-piece retaining ring 400B includes a key cutout 430 extending radially outward from the central opening, 410. The key cutout 430, in this embodiment, is operable to slide over an axial key located on a pump shaft. The key cutout 430 should generally take the shape of the axial key. Accordingly, in one embodiment the key cutout 430 is a rectangular key cutout 430. In another embodiment, the key cutout 430 is a square key cutout 430.

To assemble, the single-piece retaining ring 400B would slide over the pump shaft and the axial key, for example with the key cutout 430 aligning with the axial key. Once the single-piece retaining ring 400B is properly positioned over the cutout in the axial key, the single-piece retaining ring 400B could be rotated to extend the portion of the retaining ring (e.g., that portion of the retaining ring without the key cutout 430) into the cutout in the axial key, thus axially fixing the single-piece retaining ring 400B to the axial key. The single-piece retaining ring 400B could then be fixedly attached to the impeller, for example using the opening(s) 420 and one or more fasteners. In one embodiment, the opening 420 in the single-piece retaining ring 400B and the associated opening in the impeller only line up when the single-piece retaining ring 400B has been rotated to extend the portion of the single-piece retaining ring 400B into the axial key cutout.

The key cutout 430, such as shown, generally has a rectangular or square cross-sectional profile. Nonetheless, the present disclosure is not limited to any specific cross-sectional profile for the key cutout 430. For instance, in other embodiments, the key cutout 430 may have a round, oblong, hexagonal, tapered, or half circular (e.g., half-moon for woodruff key) cross-sectional profile, among others. The cross-sectional profile for the key cutout 430 and the associated key will generally track one another.

Figure 4C:
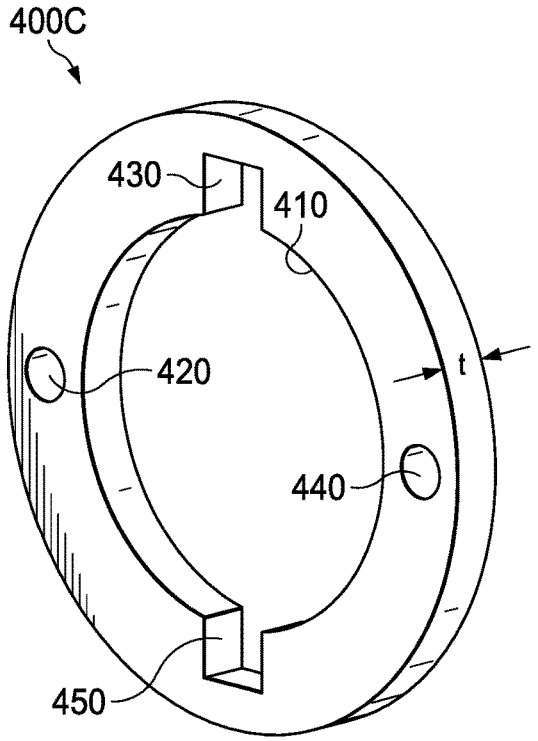

FIG. 4C illustrates a single-piece retaining ring 400C designed and manufactured according to the disclosure. The single-piece retaining ring 400C includes certain of the same features as the single-piece retaining ring 400B. Accordingly, like reference numbers have been used to indicate similar, if not identical, features. The single-piece retaining ring 400C, as illustrated, additionally includes a second opening 440, and a second key cutout 450 extending radially outward from the central opening 410. The key cutout 430 and the second key cutout 450, in the illustrated embodiment, are positioned equidistance around the central opening 410. While only two key cutouts 430, 450, are illustrated in FIG. 4C, other embodiments exist wherein more than two key cutouts are employed. Typically, the number of key cutouts should match the number of axial keys for a given axial location on the pump shaft. In the illustrated embodiment, the first key cutout 430 and the second key cutout 450 are positioned at 0-degrees and 180-degrees around the singe-piece retaining ring 410C, respectively, and the first opening 420 and the second opening 440 are positioned at 90-degrees and 270-degrees around the singe-piece retaining ring 410C, respectively. The single-piece retaining ring 400C may be installed in a manner similar to the single-piece retaining ring 400B.

Figure 4D:
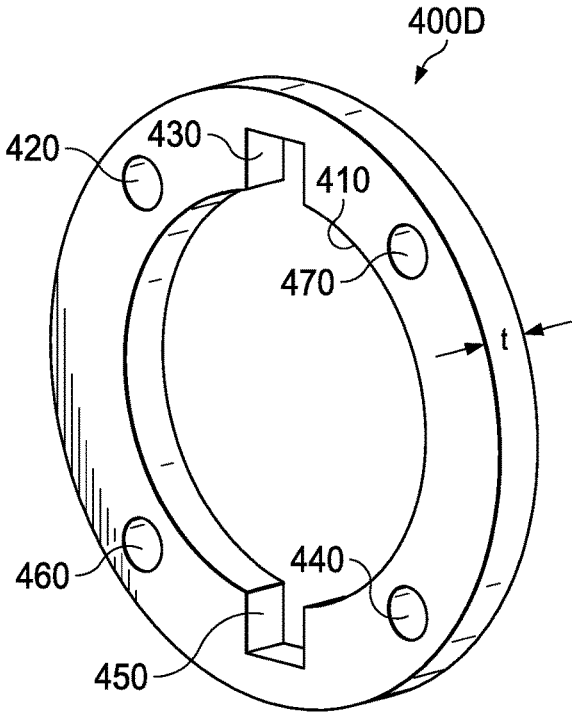

FIG. 4D illustrates a single-piece retaining ring 400D designed and manufactured according to the disclosure. The single-piece retaining ring 400D includes certain of the same features as the single-piece retaining ring 400C. Accordingly, like reference numbers have been used to indicate similar, if not identical, features. The single-piece retaining ring 400D, as illustrated, additionally includes a third opening 460, and a fourth opening 470. In this illustrated embodiment, first and second key cutouts are positioned at 0-degrees and 180-degrees around the singe-piece retaining ring 400D, respectively, and the first opening 420, the second opening 440, the third opening 460 and the fourth opening 470 are positioned at 45-degrees, 135-degrees, 225-degrees and 315-degrees around the singe-piece retaining ring 400D, respectively.

Figure 5:
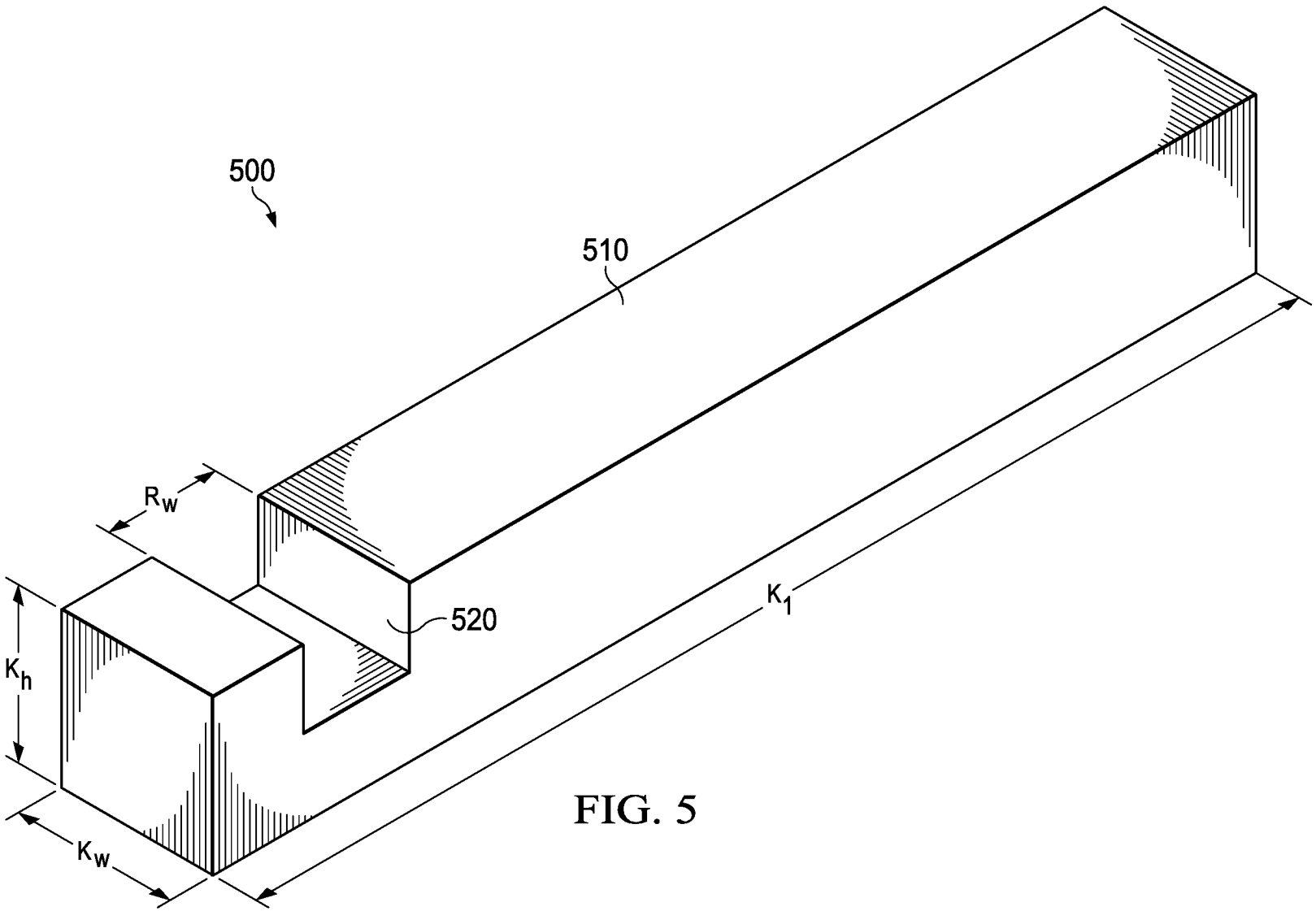
FIG. 5 illustrates an axial key, for use with a pump impeller, designed and manufactured according to the disclosure.

FIG. 5 illustrates an axial key 500, for use with a pump impeller, designed and manufactured according to the disclosure. The axial key 500, in the illustrated embodiment, includes a key 510 having a key length ($K_l$), a key width ($K_w$) and a key height ($K_h$). In the illustrated embodiment, the length ($K_l$) is greater than both of its key width ($K_w$) and key height ($K_h$). The general size and shape of the axial key 500 should be designed to appropriately fit within a desired axial keyway of a desired pump shaft. Nevertheless, in the embodiment of FIG. 5, the key 510 is a rectangular prism. In accordance with one embodiment, a recess 520 is located in the key 510 proximate an end of the key 510. In accordance with the disclosure, the recess 520 extends entirely through the key width ($K_w$) and only partially through the key height ($K_h$). In accordance with one embodiment, a width ($R_w$) of the recess 520 is less than 10 percent larger than a thickness (t) of the retaining ring (e.g., retaining ring 400A-400D illustrated in FIGS. 4A-4D).

In certain embodiments, the recess 520 is located within 25 percent of the end of the key 510. In certain other embodiments, the recess 520 is located within 10 percent of the end of the key. Similarly, in certain embodiments the recess 520 extends greater than 33 percent through the key height ($K_h$), and in yet other embodiments the recess 520 extends 50 percent through the key height ($K_h$), or even greater than 50 percent through the key height ($K_h$).

Figure 6:
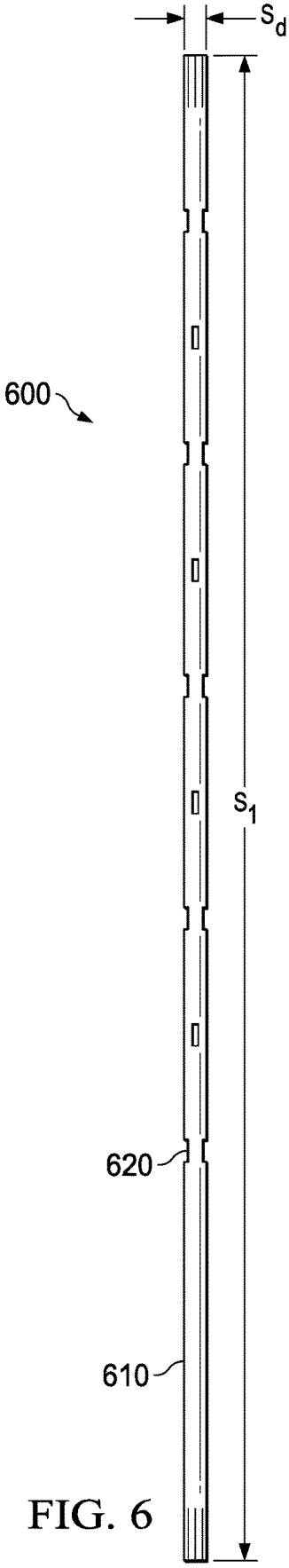
FIG. 6 illustrates a shaft for use with a pump impeller, designed and manufactured according to one embodiment of the disclosure.

FIG. 6 illustrates a shaft 600 for use with a pump impeller, designed and manufactured according to one embodiment of the disclosure. The shaft 600, in one embodiment, includes a cylindrical member 610, the cylindrical member 610 having a shaft diameter ($S_d$) and a shaft length ($S_l$). The shaft 600, in the illustrated embodiment, additionally includes one or more separate axial keyways 620 positioned along at least a portion of the cylindrical member 610, the one or more separate axial keyways 620 operable to engage one or more axial keys. Often, as shown in FIG. 6, the shaft 600 includes two or more separate axial keyways 620 positioned along at least a portion of the cylindrical member 610, the two or more separate axial keyways 620 operable to engage two or more axial keys. In accordance with the disclosure, the cylindrical member 610 is void of any circumferential grooves having a width greater than 1.5 mm (or even 3.0 mm) within 200 mm of each of the one or more separate axial keyways 620. In another embodiment, the cylindrical member 610 is void of any circumferential grooves having a width greater than 1.5 mm (or even 3.0 mm) within 100 mm of each of the one or more separate axial keyways 620. In yet another embodiment, the cylindrical member 610 is void of any circumferential grooves having a width greater than 1.5 mm (or even 3.0 mm) within 50 mm of each of the one or more separate axial keyways 620. In yet an alternative embodiment, the cylindrical member 610 is void of any circumferential grooves of any size under each of the one or more separate axial keyways 620, and in another embodiment the cylindrical member 610 is void of any circumferential grooves having a width greater than 1.5 mm (or even 3.0 mm) along its shaft length ($S_l$).

While the embodiment of FIG. 6 has been described as having two or more separate axial keyways 620, other embodiments may exist wherein more than two separate axial keyways 620 are employed. For example, four or more separate axial keyways 620 may be positioned along at least a portion of the cylindrical member 610, and in this embodiment the cylindrical member 610 is void of any circumferential grooves within 200 mm of each of the four or more separate axial keyways 620.

Aspects disclosed herein include:

A. A centrifugal pump, the centrifugal pump including a shaft having an axial keyway located therein; an axial key positioned within the axial keyway, the axial key having a recess located in a radial exterior surface thereof; an impeller positioned on the shaft about the axial key; a retaining ring positioned on the shaft about the axial key, a portion of the retaining ring extending into the recess for axially fixing the retaining ring relative to the axial key; one or more fasteners attaching the retaining ring to the impeller; and a diffuser coupled about the shaft and proximate the impeller.

B. A pump assembly, the pump assembly including: 1) a centrifugal pump, including: a) a shaft having an axial keyway located therein; b) an axial key positioned within the axial keyway, the axial key having a recess located in a radial exterior surface thereof; c) an impeller positioned on the shaft about the axial key; d) a retaining ring positioned on the shaft about the axial key, a portion of the retaining ring extending into the recess for axially fixing the retaining ring relative to the axial key; e) one or more fasteners attaching the retaining ring to the impeller, and f) a diffuser coupled about the shaft and proximate the impeller; and 2) a rotary actuator coupled to the centrifugal pump and rotationally engaged with the shaft.

C. A well system, the well system including: 1) a wellbore extending from the earth's surface through one or more subterranean formations; 2) a wellhead positioned over the wellbore and proximate the earth's surface; 3) production tubing extending from the wellhead through at least one of the one or more subterranean formations; 4) a pump assembly coupled proximate a lower end of the production tubing, the pump assembly comprising: a) a centrifugal pump, including: 1) a shaft having an axial keyway located therein;

ii) an axial key positioned within the axial keyway, the axial key having a recess located in a radial exterior surface thereof; iii) an impeller positioned on the shaft about the axial key; iv) a retaining ring positioned on the shaft about the axial key, a portion of the retaining ring extending into the recess for axially fixing the retaining ring relative to the axial key; v) one or more fasteners attaching the retaining ring to the impeller; and vi) a diffuser coupled about the shaft and proximate the impeller; and v) a rotary actuator coupled to the centrifugal pump and rotationally engaged with the shaft.

D. A retaining ring for use with a pump impeller, the retaining ring including: a single-piece retaining ring having a central opening for positioning around a shaft of a pump; a key cutout extending radially outward from the central opening, the key cutout operable to slide over an axial key located on the shaft; one or more openings extending through a thickness (t) of the single-piece retaining ring, the one or more openings operable to axially fix the single-piece retaining ring to the pump impeller.

E. An axial key for use with a pump impeller, the axial key including: a key having a key length ($K_l$), a key width ($K_w$) and a key height ($K_h$), the key length ($K_l$) greater than both of its key width ($K_w$) and key height ($K_h$), and a recess located proximate an end of the key, the recess extending entirely through the key width ($K_w$) and only partially through the key height ($K_b$).

F. A shaft for use with a pump impeller, the shaft including: a cylindrical member, the cylindrical member having a shaft diameter ($S_d$) and a shaft length ($S_l$); and one or more separate axial keyways positioned axially along at least a portion of the cylindrical member, the one or more separate axial keyways operable to engage one or more axial keys, and further wherein the cylindrical member is void of any circumferential grooves having a width greater than 1.5 mm within 200 mm of each of the one or more separate axial keyways.

Aspects A, B, and C may have one or more of the following additional elements in combination: Element 1: wherein the axial keyway is a first axial keyway, the axial key is a first axial key, and the recess is a first recess, and further including a second axial keyway located in the shaft and a second axial key positioned within the second axial keyway, the second axial keyway having a second recess located in a radial exterior surface thereof, and further wherein the portion of the retaining ring extends into the first and second recesses for axially fixing the retaining ring to the impeller. Element 2: wherein the retaining ring is a multi-piece retaining ring having a central opening for positioning around the shaft, and further wherein one or more fasteners attach each portion of the multi-piece retaining ring to the impeller. Element 3: wherein the retaining ring is a single-piece retaining ring having a central opening for positioning around the shaft and first and second key cutouts extending radially outward from the central opening for sliding over the first and second axial keys, the single-piece retaining ring configured to slide over the first and second axial keys and rotate to extend the portion of the retaining ring into the first and second cutouts in the first and second axial keys for axially fixing the single-piece retaining ring to the first and second axial keys. Element 4: wherein the one or more fasteners are one or more bolts extending through associated openings in the retaining ring and the impeller. Element 5: wherein the associated openings in the retaining ring and the impeller only line up when the single-piece retaining ring has been rotated to extend the portion of the retaining ring into the first and second cutouts. Element 6: wherein the first and second axial keyways and first and second axial keys are placed circumferentially equidistance around the shaft. Element 7: wherein the retaining ring is a single-piece retaining ring having a central opening for positioning around the shaft and a cutout extending radially outward from the central opening for sliding over the axial key, the single-piece retaining ring configured to slide over the axial key and rotate to extend the portion of the retaining ring into the cutout in the axial key for axially fixing the single-piece retaining ring to the axial key. Element 8: wherein a width ($R_w$) of the recess is less than 10 percent larger than a thickness (t) of the retaining ring. Element 9: wherein the shaft is positioned within a housing, a volute, or a diffuser. Element 10: wherein the axial keyway is a first axial keyway, the axial key is a first axial key, and the recess is a first recess, and further including a second axial keyway located in the shaft and a second axial key positioned within the second axial keyway, the second axial keyway having a second recess located in a radial exterior surface thereof, and further wherein the portion of the retaining ring extends into the first and second recesses for axially fixing the retaining ring to the impeller. Element 11: wherein the retaining ring is a multi-piece retaining ring having a central opening for positioning around the shaft, and further wherein one or more fasteners attach each portion of the multi-piece retaining ring to the impeller. Element 12: wherein the retaining ring is a single-piece retaining ring having a central opening for positioning around the shaft and first and second key cutouts extending radially outward from the central opening for sliding over the first and second axial keys, the single-piece retaining ring configured to slide over the first and second axial keys and rotate to extend the portion of the retaining ring into the first and second cutouts in the first and second axial keys for axially fixing the single-piece retaining ring to the first and second axial keys. Element 13: wherein the one or more fasteners are one or more bolts extending through associated openings in the retaining ring and the impeller. Element 14: wherein the associated openings in the retaining ring and the impeller only line up when the single-piece retaining ring has been rotated to extend the portion of the retaining ring into the first and second cutouts Element 15: wherein the axial key has a key length ($K_l$), a key width ($K_w$) and a key height ($K_h$), the key length ($K_l$) greater than both of its key width ($K_w$) and key height ($K_h$), and further wherein the recess is located proximate an end of the axial key, the recess extending entirely through the key width ($K_w$) and only partially through the key height ($K_h$). Element 16: wherein the recess is located within 25 percent of the end of the axial key. Element 17: wherein the axial keyway is a first axial keyway, the axial key is a first axial key, and the recess is a first recess, and further including a second axial keyway located in the shaft and a second axial key positioned within the second axial keyway, the second axial keyway having a second recess located in a radial exterior surface thereof, and further wherein the retaining ring is a single-piece retaining ring having a central opening for positioning around the shaft and first and second key cutouts extending radially outward from the central opening for sliding over the first and second axial keys, the single-piece retaining ring configured to slide over the first and second axial keys and rotate to extend the portion of the retaining ring into the first and second cutouts in the first and second axial keys for axially fixing the single-piece retaining ring to the first and second axial keys. Element 18: wherein the one or more openings are two or more openings positioned equidistance around the single-piece retaining ring. Element 19: wherein the key cutout is a first key cutout, and further including one or more additional key cutout extending radially outward from the central opening, the first key cutout and one or more additional key cutouts positioned equidistance around the central opening. Element 20: wherein the two or more openings interleave the first key cutout and one or more additional key cutouts. Element 21: wherein the two key cutouts are positioned at 0-degrees and 180-degrees, respectively, and two openings are positioned at 90-degrees and 270-degrees, respectively, around the singe-piece retaining ring. Element 22: wherein the two key cutouts are positioned at 0-degrees and 180-degrees, respectively, and four openings are positioned at 45-degrees, 135-degrees, 225-degrees and 315-degrees, respectively, around the singe-piece retaining ring. Element 23: wherein a cross-sectional profile of the key cutout is rectangular or square. Element 24: wherein a cross-sectional profile of the key cutout is square. Element 25: wherein the recess is located within 25 percent of the end of the key. Element 26: wherein the recess is located within 10 percent of the end of the key. Element 27: wherein the recess extends greater than 33 percent through the key height ($K_h$). Element 28: wherein the recess extends 50 percent through the key height ($K_h$). Element 29: wherein the key is a rectangular prism. Element 30: wherein the cylindrical member is void of any circumferential grooves having a width greater than 1.5 mm within 100 mm of each of the two or more separate axial keyways. Element 31: wherein the cylindrical member is void of any circumferential grooves having a width greater than 1.5 mm within 50 mm of each of the two or more separate axial keyways. Element 32: wherein the cylindrical member is void of any circumferential grooves of any size under each of the two or more separate axial keyways. Element 33: wherein the cylindrical member is void of any circumferential grooves having a width greater than 1.5 mm along its shaft length ($S_l$). Element 34: wherein four or more separate axial keyways are positioned along at least a portion of the cylindrical member, and further wherein the cylindrical member is void of any circumferential grooves having a width greater than 1.5 mm within 200 mm of each of the four or more separate axial keyways.

Further additions, deletions, substitutions and modifications may be made to the described embodiments.

What is claimed is:

1. A centrifugal pump, comprising:

a shaft having an axial keyway located therein;

an axial key positioned within the axial keyway, the axial key having a recess located in a radial exterior surface thereof;

an impeller positioned on the shaft about the axial key;

a retaining ring positioned on the shaft about the axial key, a portion of the retaining ring extending into the recess for axially fixing the retaining ring relative to the axial key;

one or more fasteners attaching the retaining ring to the impeller; and a diffuser coupled about the shaft and proximate the impeller.

2. The centrifugal pump as recited in claim 1, wherein the axial keyway is a first axial keyway, the axial key is a first axial key, and the recess is a first recess, and further including a second axial keyway located in the shaft and a second axial key positioned within the second axial keyway, the second axial keyway having a second recess located in a radial exterior surface thereof, and further wherein the portion of the retaining ring extends into the first and second recesses for axially fixing the retaining ring to the impeller.

3. The centrifugal pump as recited in claim 2, wherein the retaining ring is a multi-piece retaining ring having a central opening for positioning around the shaft, and further wherein one or more fasteners attach each portion of the multi-piece retaining ring to the impeller.

4. The centrifugal pump as recited in claim 2, wherein the retaining ring is a single-piece retaining ring having a central opening for positioning around the shaft and first and second key cutouts extending radially outward from the central opening for sliding over the first and second axial keys, the single-piece retaining ring configured to slide over the first and second axial keys and rotate to extend the portion of the retaining ring into the first and second cutouts in the first and second axial keys for axially fixing the single-piece retaining ring to the first and second axial keys.

5. The centrifugal pump as recited in claim 4, wherein the one or more fasteners are one or more bolts extending through associated openings in the retaining ring and the impeller.

6. The centrifugal pump as recited in claim 5, wherein the associated openings in the retaining ring and the impeller only line up when the single-piece retaining ring has been rotated to extend the portion of the retaining ring into the first and second cutouts.

7. The centrifugal pump as recited in claim 2, wherein the first and second axial keyways and first and second axial keys are placed circumferentially equidistance around the shaft.

8. The centrifugal pump as recited in claim 1, wherein the retaining ring is a single-piece retaining ring having a central opening for positioning around the shaft and a cutout extending radially outward from the central opening for sliding over the axial key, the single-piece retaining ring configured to slide over the axial key and rotate to extend the portion of the retaining ring into the cutout in the axial key for axially fixing the single-piece retaining ring to the axial key.

9. The centrifugal pump as recited in claim 1, wherein a width ($R_w$) of the recess is less than 10 percent larger than a thickness (t) of the retaining ring.

10. The centrifugal pump as recited in claim 1, wherein the shaft is positioned within a housing, a volute, or a diffuser.

11. A pump assembly, comprising:

a centrifugal pump, including:

a shaft having an axial keyway located therein;

an axial key positioned within the axial keyway, the axial key having a recess located in a radial exterior surface thereof;

an impeller positioned on the shaft about the axial key;

a retaining ring positioned on the shaft about the axial key, a portion of the retaining ring extending into the recess for axially fixing the retaining ring relative to the axial key;

one or more fasteners attaching the retaining ring to the impeller; and a diffuser coupled about the shaft and proximate the impeller; and a rotary actuator coupled to the centrifugal pump and rotationally engaged with the shaft.

12. The pump assembly as recited in claim 11, wherein the axial keyway is a first axial keyway, the axial key is a first axial key, and the recess is a first recess, and further including a second axial keyway located in the shaft and a second axial key positioned within the second axial keyway, the second axial keyway having a second recess located in a radial exterior surface thereof, and further wherein the portion of the retaining ring extends into the first and second recesses for axially fixing the retaining ring to the impeller.

13. The pump assembly as recited in claim 12, wherein the retaining ring is a multi-piece retaining ring having a central opening for positioning around the shaft, and further wherein one or more fasteners attach each portion of the multi-piece retaining ring to the impeller.

14. The pump assembly as recited in claim 12, wherein the retaining ring is a single-piece retaining ring having a central opening for positioning around the shaft and first and second key cutouts extending radially outward from the central opening for sliding over the first and second axial keys, the single-piece retaining ring configured to slide over the first and second axial keys and rotate to extend the portion of the retaining ring into the first and second cutouts in the first and second axial keys for axially fixing the single-piece retaining ring to the first and second axial keys.

15. The pump assembly as recited in claim 14, wherein the one or more fasteners are one or more bolts extending through associated openings in the retaining ring and the impeller.

16. The pump assembly as recited in claim 15, wherein the associated openings in the retaining ring and the impeller only line up when the single-piece retaining ring has been rotated to extend the portion of the retaining ring into the first and second cutouts.

17. The pump assembly as recited in claim 11, wherein the axial key has a key length ($K_l$), a key width ($K_w$) and a key height ($K_h$), the key length ($K_l$) greater than both of its key width ($K_w$) and key height ($K_h$), and further wherein the recess is located proximate an end of the axial key, the recess extending entirely through the key width ($K_w$) and only partially through the key height ($K_h$).

18. The pump assembly as recited in claim 17, wherein the recess is located within 25 percent of the end of the axial key.

19. A well system, comprising:

a wellbore extending from the earth's surface through one or more subterranean formations;

a wellhead positioned over the wellbore and proximate the earth's surface;

production tubing extending from the wellhead through at least one of the one or more subterranean formations;

a pump assembly coupled proximate a lower end of the production tubing, the pump assembly comprising:

a centrifugal pump, including:

a shaft having an axial keyway located therein;

an axial key positioned within the axial keyway, the axial key having a recess located in a radial exterior surface thereof;

an impeller positioned on the shaft about the axial key;

a retaining ring positioned on the shaft about the axial key, a portion of the retaining ring extending into the recess for axially fixing the retaining ring relative to the axial key;

one or more fasteners attaching the retaining ring to the impeller; and a diffuser coupled about the shaft and proximate the impeller; and a rotary actuator coupled to the centrifugal pump and rotationally engaged with the shaft.

20. The well system as recited in claim 19, wherein the axial keyway is a first axial keyway, the axial key is a first axial key, and the recess is a first recess, and further including a second axial keyway located in the shaft and a second axial key positioned within the second axial keyway, the second axial keyway having a second recess located in a radial exterior surface thereof, and further wherein the retaining ring is a single-piece retaining ring having a central opening for positioning around the shaft and first and second key cutouts extending radially outward from the central opening for sliding over the first and second axial keys, the single-piece retaining ring configured to slide over the first and second axial keys and rotate to extend the portion of the retaining ring into the first and second cutouts in the first and second axial keys for axially fixing the single-piece retaining ring to the first and second axial keys.

* * * * *